US005379200A

United States Patent [19]

Echard

[11] Patent Number: 5,379,200

[45] Date of Patent: Jan. 3, 1995

[54] PORTABLE ELECTRIC LANTERN APPARATUS

[76] Inventor: Terry P. Echard, Rte. 1 Box 220A, Harrisville, W. Va. 26362

[21] Appl. No.: 175,129

[22] Filed: Dec. 29, 1993

[51] Int. Cl.[6] ..... F21L 11/00

[52] U.S. Cl. ..... 362/186; 362/157; 362/183; 362/190

[58] Field of Search ..... 362/157, 183, 186, 161, 362/376, 810, 399, 190, 191, 277

[56] References Cited

U.S. PATENT DOCUMENTS

| | | | |
|---|---|---|---|
| D. 311,592 | 10/1990 | Jones . | |
| 445,627 | 4/1836 | Rask | 362/186 |
| 571,317 | 11/1896 | Brigham | 362/161 |
| 1,205,628 | 11/1916 | Hitzelberger | 362/810 |
| 2,066,510 | 1/1939 | Younkman et al. | 362/186 |
| 3,139,556 | 6/1964 | Grontkowski | 362/186 |
| 3,456,102 | 7/1969 | Brindley et al. . | |
| 3,767,911 | 10/1973 | Oakley et al. . | |
| 3,800,136 | 3/1974 | Edelson | 362/157 |
| 4,150,302 | 4/1979 | Roche | 362/183 |
| 4,268,894 | 5/1981 | Bartunek et al. | 362/183 |
| 4,286,310 | 8/1981 | Brainkel et al. . | |
| 4,562,521 | 12/1985 | Noguchi . | |

FOREIGN PATENT DOCUMENTS

| | | | |
|---|---|---|---|
| 627544 | 11/1961 | Italy | 362/186 |

*Primary Examiner*—Ira S. Lazarus
*Assistant Examiner*—Y. Quach

[57] ABSTRACT

A new and improved portable electric lantern apparatus includes a base assembly which includes a housing portion, a lamp-supporting portion supported by the housing portion, and a light-diffuser-retaining portion supported by the lamp-supporting portion. A plurality of strut members are connected to the base assembly and project upward from the base assembly. A handle-supporting assembly is connected to the strut members. A handle is supported by the handle-supporting assembly. The handle is located above the base assembly and above the strut members. The handle is connected to the handle-supporting assembly by a pivoted connection. The handle includes a curved portion adapted to be hung from a wall fastener. A light diffuser is supported by the light-diffuser-retaining portion of the base assembly. The light diffuser extends upward from the base assembly toward the handle-supporting assembly. The light-diffuser-retaining portion is comprised of a plurality of resilient leaves arrayed circumferentially around the light diffuser. The lamp assembly may include a lamp that includes a bulbous bottom portion and pointed top portion such that the lamp resembles a flame. An illumination modulation assembly is placed in an electrical circuit between the lamp and the electrical power source. The illumination modulation assembly includes both a circuit interrupter for causing illumination from the lamp to flicker in simulation of a flange and a dimmer assembly for dimming illumination provided by the lamp.

13 Claims, 4 Drawing Sheets

FIG. 3
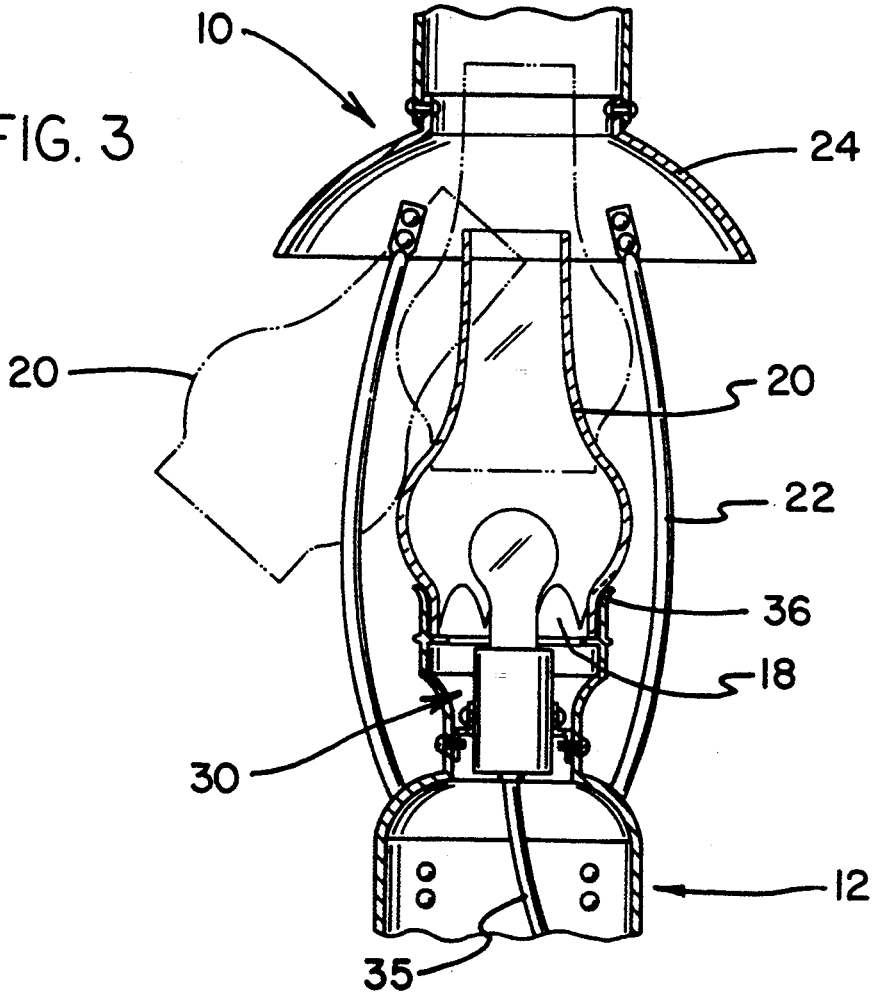
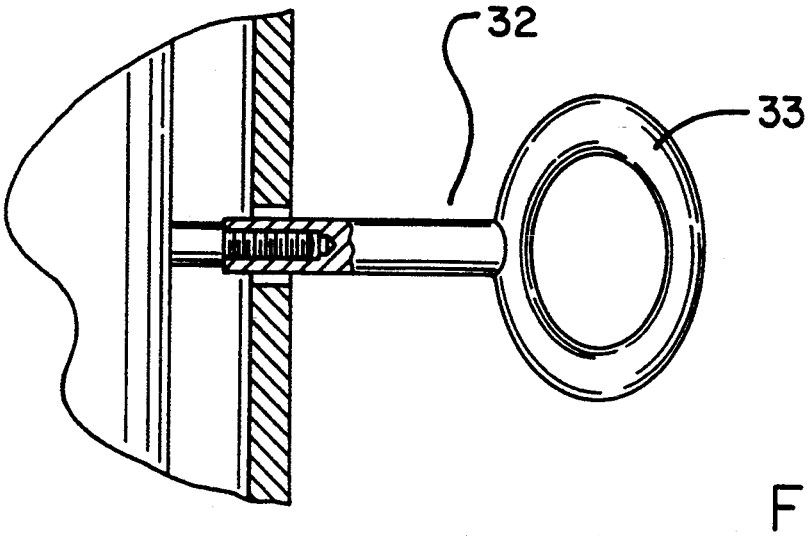
FIG. 4

PORTABLE ELECTRIC LANTERN APPARATUS

BACKGROUND OF THE INVENTION

1. Field of the Invention

The present invention relates generally to electric lamps and, more particularly, to electric lamps that are portable.

2. Description of the Prior Art

Portable illumination devices are very useful and come in wide variety of shapes and sizes. Most portable illumination devices are powered by electric current, either centrally distributed AC power or DC batteries. There are, however, portable illumination devices that are powered by combustion of a liquid fuel. One such combustion-powered portable illumination device is an oil lantern.

The oil lantern has a number of desirable features. It has a relatively long, vertically oriented globe which provides an especially utilitarian as well as aesthetic function. The oil lantern has quite a bit of its weight relatively close to its base providing it with a low center of gravity which provides substantial stability against being tipped over. The oil lantern also has a wire carrying handle that is located at the top of the lamp. This location of the handle permits a good grasp. In addition, the wire permits a person to wrap one's hand around the wire and form a tight grip. The wire handle also permits the lamp to be hung by its handle.

Aside from its desirable features, the oil lantern has a number of disadvantages. The fuel is unpleasantly odorous and breathing fuel vapors may be unhealthy. If the fuel leaks, a substantial fire hazard can be created. Fuel must be periodically replenished. The oil lantern generates quite a bit of heat as well as light, and the heat may be undesirable in certain weather conditions, such as hot summer days. To start the oil lantern, one must have a source of ignition such as a match. Often a match is not readily available. Moreover, in a dark room a person may need two hands to partially disassembly the oil lantern in order to light it. It may be difficult for the person to use two hands in a dark room when one hand may be needed to carry a lighted match.

Although the oil lantern has both desirable features and disadvantages, for most people the disadvantages outweigh the desirable features, and use of oil lanterns is quite limited. In this respect, it would be desirable if a portable illumination device were provided which has the desirable features of an oil lantern but does not have the disadvantages associated with the oil lantern.

Many of the desirable features of the oil lantern can be obtained by an electrically powered portable illumination device. More specifically, it would be desirable if an electrically-powered portable illumination device were provided which has a relatively long, vertically oriented globe which provides a utilitarian as well as an aesthetic function. It would also be desirable if an electrically-powered portable illumination device were provided which has quite a bit of its weight relatively close to its base providing it with a low center of gravity which provides substantial stability against being tipped over. In addition, it would be desirable if an electrically-powered portable illumination device had a wire carrying handle that is located at the top of the lamp.

In addition, many of the disadvantages of the oil lantern can be eliminated by employing an electrically-powered portable illumination device. More specifically, the use of an electrically-powered portable illumination device precludes the presence of a liquid fuel that is unpleasantly odorous and gives off vapors that may be unhealthy to breath. An electrically-powered portable illumination device precludes fuel leaks and eliminates a fire hazard that can result from a fuel leak. In addition, an electrically-powered portable illumination device does not present a problem of incomplete fuel combustion, does not require replenishment of a liquid fuel, does not require a match to start, and does not require two free hands to start the lantern illuminating.

Throughout the years, a number of innovations have been developed relating to electrically-powered portable illumination devices, and the following U.S. patents are representative of some of those innovations: U.S. Pat. No. 3,456,102; 3,767,911; 4,286,310; 4,562,521; and U.S. Pat. Des. No. 311,592.

More specifically, U.S. Pat. No. 3,456,102 discloses a portable electric hand lantern that includes a reflector for directing the light in a monodirectional beam. Often a light source is desired that provides illumination in a 360 degree circle, not is a monodirectional beam. In this respect, it would be desirable if a portable illumination device provided illumination in a 360 degree circle.

U.S. Pat. No. 3,767,911 discloses a battery-powered electric lantern which includes a centrally disposed rod that serves as a support and backbone for a battery case, a lens, and a plurality of lamps. A plurality of lamps are arrayed circumferentially around the centrally located support rod. The support rod, aside from providing its support function, also serves as an electrical conductor in the electric circuit. A disadvantage is imposed by the centrally disposed support rod. It prevents a source of illumination from being disposed in a central location in the lamp. The centrally located disposition of the support rod requires that the sources of illumination be arrayed circumferentially around the support rod. The visual effects of circumferentially arrayed lamps versus the visual effects of a centrally located lamp are quite different. In this respect, it would be desirable if an electrically-powered portable illumination device were provided which includes a centrally disposed source of illumination.

Moreover, the centrally disposed support rod in U.S. Pat. No. 3,767,911 serves as an electrical conductor in the lamp circuit. Such a dual role poses hidden dangers. It subjects the support rod to short circuits. Also, if the support rod becomes slightly bent, it may be prevented from providing electrical continuity in its circuit contacts. Thus, a lamp that undergoes slight structural damage may be completely disabled by being unable to provide circuit continuity for powering a lamp. In this respect, it would be desirable if an electrically-powered portable illumination device were provided which did not include a structural support rod that also serves as an electrical conductor in the lamp circuit.

U.S. Pat. No. 4,286,310 discloses a battery-powered lantern that includes a transparent upper light diffuser that is supported by a lower battery case. A handle or aperture for suspending the lamp from an overhead support is integrally formed with the light diffuser. As a result, when the lamp is suspended from an overhead support, the weight of the batteries and the battery case must be supported by the light diffuser. In this case, the light diffuser must serve two opposing functions: provide light diffusion; and provide structural support for the batteries and battery case. Preferably, it should not be necessary for a light diffuser to also serve as a structural support for the batteries and battery case. In this respect, it would be desirable if an electrically-powered portable illumination device were provided that included a light diffuser which does is not required to provide structural support for a battery and a battery case.

U. S. Pat. No. 4,562,521 discloses a conventional lamp stand that is adapted to receive a collapsible oriental lantern. U.S. Pat. Des. No. 311,592 is similar to U.S. Pat. No. 3,456,102 discussed above for its disclosure of an electrically-powered portable illumination device which includes a reflector for directing the light in a monodirectional beam.

Still other features would be desirable in a portable electric lantern apparatus. For example, an act,,ml fuel oil-powered lantern may provide a source of illumination that flickers as the flame flickers. Such a flickering light source may be pleasing to some persons, and it would be desirable if an electrically powered portable illumination device had a flickering light source.

Thus, while the foregoing body of prior art indicates it to be well known to use an electrically-powered portable illumination device, the prior art described above does not teach or suggest a portable electric lantern apparatus which has the following combination of desirable features: (1) has the desirable features of a fuel-oil powered lantern but does not have the disadvantages associated with the oil lantern; (2) has a relatively long, vertically oriented, light diffuser which provides a utilitarian as well as an aesthetic function; (3) has quite a bit of its weight relatively close to its base providing it with a low center of gravity which provides substantial stability against being tipped over; (4) has a wire handle that is located above the lamp; (5) precludes the presence of a liquid fuel that is unpleasantly odorous and that gives off vapors that may be unhealthy to breath; (6) precludes fuel leaks and eliminates a fire hazard that can result from a fuel leak; (7) does not present a problem of incomplete fuel combustion, does not require replenishment of a liquid fuel, does not require a match to start, and does not require two free hands to start the lantern to illuminate; (8) provides illumination in a 360 degree circle; (9)includes a centrally disposed source of illumination; (10) does not include a structural support rod that also serves as an electrical conductor in the lamp circuit; (11) includes a light diffuser which is not required to provide structural support for a battery and a battery case; and (12) has a flickering light source. The foregoing desired characteristics are provided by the unique portable electric lantern apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved portable electric lantern apparatus which includes a base assembly which includes a housing portion, a lamp-supporting portion supported by the housing portion, and a light-diffuser-retaining portion supported by the lamp-supporting portion. A plurality of strut members are connected to the base assembly and project upward from the base assembly. A handle-supporting assembly is connected to the strut members. A handle is supported by the handle-supporting assembly. The handle is located above the base assembly and above the strut members. The handle is connected to the handle-supporting assembly by a pivoted connection. The handle includes a curved portion adapted to be hang from a wall fastener.

A light diffuser is supported by the light-diffuser-retaining portion of the base assembly. The light diffuser extends upward from the base assembly toward the handle-supporting assembly. The light-diffuser-retaining portion is comprised of a plurality of resilient leaves arrayed circumferentially around the light diffuser. A lamp assembly is supported by the lamp-supporting portion of the base assembly. The lamp assembly is supported by the lamp-supporting portion such that the lamp assembly is centrally disposed in the light diffuser when the light diffuser is supported by the light-diffuser-retaining portion of the base assembly.

A switch assembly is supported by the base assembly for controlling operation of the lamp assembly, An electrical power source provides electrical power to the lamp assembly and the switch assembly. The switch assembly is supported by the lamp-supporting portion of the base assembly.

The lamp assembly is powered by DC current derived from a step down transformer and an AC to DC converter. Alternatively, the lamp assembly is powered by DC current derived from a battery supply. The battery supply is stored in the housing portion of the base assembly. The battery supply includes rechargeable batteries.

The lamp assembly may include a lamp that includes a bulbous bottom portion and pointed top portion such that the lamp resembles a flame. An illumination modulation assembly is placed in an electrical circuit between the lamp and the electrical power source. The illumination modulation assembly includes both a circuit interrupter for causing illumination from the lamp to flicker in simulation of a flame and a dimmer assembly for dimming illumination provided by the lamp.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved portable electric lantern apparatus which has all of the advantages of the prior art and none of the disadvantages.

It is another object of the present invention to provide a new and improved portable electric lantern apparatus which may be easily and efficiently manufactured and marketed.

It is a further object of the present invention to provide a new and improved portable electric lantern apparatus which is of durable and reliable construction.

An even further object of the present invention is to provide a new and improved portable electric lantern apparatus which is susceptible of a low cost of manufacture with regard to both materials and labor, and which accordingly is then susceptible of low prices of sale to the consuming public, thereby making such portable electric lantern apparatus available to the buying public.

Still yet a further object of the present invention is to provide a new and improved portable electric lantern apparatus which has the desirable features of a fuel-oil powered lantern but does not have the disadvantages associated with the oil lantern.

Still another object of the present invention is to provide a new and improved portable electric lantern apparatus that has a relatively long, vertically oriented, light diffuser which provides a utilitarian as well as an aesthetic function.

Yet another object of the present invention is to provide a new and improved portable electric lantern apparatus which has quite a bit of its weight relatively close to its base providing it with a low center of gravity which provides substantial stability against being tipped over.

Even another object of the present invention is to provide a new and improved portable electric lantern apparatus that has a wire handle that is located above the lamp.

Still a further object of the present invention is to provide a new and improved portable electric lantern apparatus which precludes the presence of a liquid fuel that is unpleasantly odorous and that gives off vapors that may be unhealthy to breath.

Yet another object of the, present invention is to provide a new and improved portable electric lantern apparatus that precludes fuel leaks and eliminates a fire hazard that can result from a fuel leak.

Still another object of the present invention is to provide a new and improved portable electric lantern apparatus which does not present a problem of incomplete fuel combustion, does not require replenishment of a liquid fuel, does not require a match to start, and does not require two free hands to start the lantern to illuminate.

Yet another object of the present invention is to provide a new and improved portable electric lantern apparatus that provides illumination in a 360 degree circle.

Still a further object of the present invention is to provide a new and improved portable electric lantern apparatus that includes a centrally disposed source of illumination.

Yet another object of the present invention is to provide a new and improved portable electric lantern apparatus which does not include a structural support rod that also serves as an electrical conductor in the lamp circuit.

Still a further object of the present invention is to provide a new and improved portable electric lantern apparatus that includes a light diffuser which is not required to provide structural support for a battery and a battery case.

Yet another object of the present invention is to provide a new and improved portable electric lantern apparatus which has a flickering light source.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged cross-sectional view of the embodiment shown in FIG. 2 illustrating removal of the light diffuser to permit replacement of an electric lamp.

FIG. 4 is an enlarged side view of the switch handle shown in FIG. 1 for turning the lamp on and off.

DESCRIPTION OF THE PREFERRED EMBODIMENT

Figure 1:
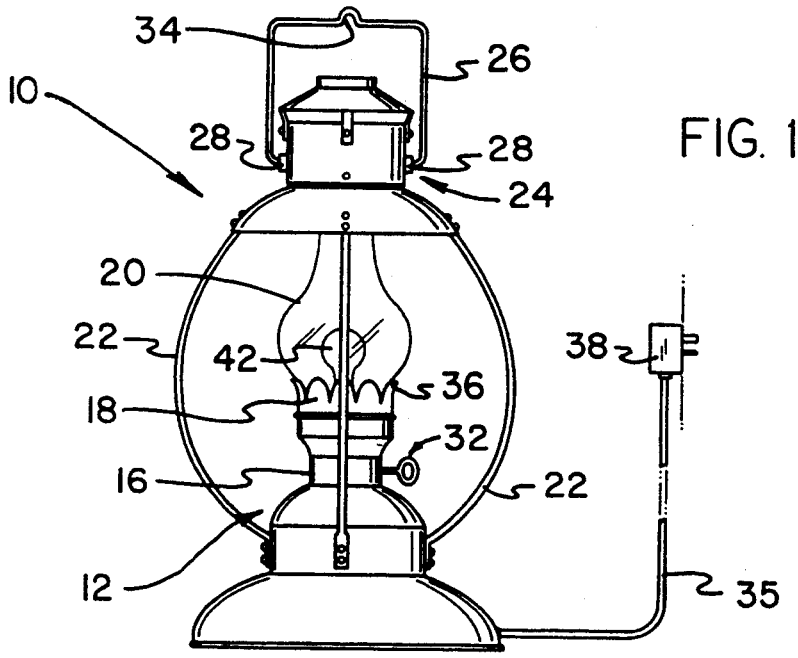
FIG. 1 is a side view showing a first preferred embodiment of the portable electric lantern apparatus of the invention which includes a DC powered lamp and which includes an AC to DC converter plugged into a source of AC power.
Figure 2:
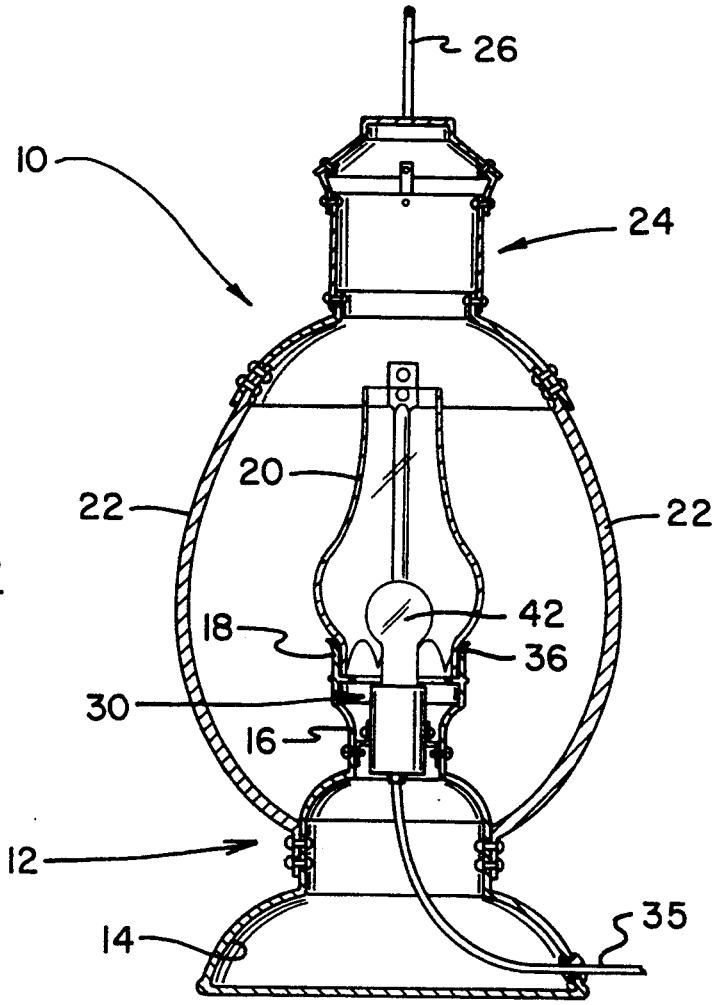
FIG. 2 is an enlarged cross-sectional view of the embodiment of the portable electric lantern apparatus of FIG. 1.

With reference to the drawings, a new and improved portable electric lantern apparatus embodying the principles and concepts of the present invention will be described.

Turning initially to FIGS. 1–4, there is shown a first exemplary embodiment of the portable electric lantern apparatus of the invention generally designated by reference numeral 10. In its preferred form, portable electric lantern apparatus 10 includes a base assembly 12 which includes a housing portion 14, a lamp-supporting portion 16 supported by the housing portion 14, and a light-diffuser-retaining portion 18 supported by the lamp-supporting portion 16. A plurality of strut members 22 are connected to the base assembly 12 and project upward from the base assembly 12. A handle-supporting assembly 24 is connected to the strut members 22. Rivets or any other suitable connectors can be used to connect the strut members 22 to the base assembly 12 and the handle-supporting assembly 24 to the strut members 22. handle 26 is supported by the handle-supporting assembly 24. The handle 26 is located above the base assembly 12 and above the strut members 22. The handle 26 is connected to the handle-supporting assembly 24 by a pivoted connection 28.

A light diffuser 20 is supported by the light-diffuser-retaining portion 18 of the base assembly 12. The light diffuser 20 extends upward from the base assembly 12 toward the handle-supporting assembly 24. A lamp assembly 30 is supported by the lamp-supporting portion 16 of the base assembly 12. The lamp assembly 30 is supported by the lamp-supporting portion 16 such that the lamp assembly 30 is centrally disposed in the light diffuser 20 when the light diffuser 20 is supported by the light-diffuser-retaining portion 18 of the base assembly 12.

A switch assembly 32 is supported by the base assembly 12 for controlling operation of the lamp assembly 30. An electrical power source provides electrical power to the lamp assembly 30 and the switch assembly 32.

The overall appearance of the portable electric lantern apparatus 10 of the invention is that of an oil burning lantern. Each visible component is designed to simulate a corresponding component on an oil burning lantern. In this respect, the overhead handle 26 and the pivoted connection 28 which permits the lantern to swing when the lantern is carried further simulates an oil burning lantern. The switch assembly 32 is supported by the lamp-supporting portion 16 of the base assembly 12. The handle 33 for the switch assembly 32 resembles the wick-control handle for an oil burning lantern. In this respect, the switch assembly 32 operates as a rotary switch as the handle 33 is rotated in simulation of wick control.

The handle 26 includes a curved portion 34 adapted to be hung from a wall fastener such as a nail or a screw driven into the wall. The curved portion 34 may also be used to hang the portable electric lantern apparatus 10 of the invention from a wire or the like.

The light-diffuser-retaining portion 18 is comprised of a plurality of resilient leaves 36 arrayed circumferentially around the light diffuser 20. As shown in FIG. 3, to change a lamp 42, the light diffuser 20 is lifted out of the light-diffuser-retaining portion 18 and carried away from the lamp assembly 30. The combination of top portions of the strut members 22 and the handle-supporting assembly 24 is positioned a sufficient distance from the base assembly 12 and the light diffuser 20 such that a clearance is provided between the light diffuser 20 and the handle-supporting assembly 24 which is sufficient to permit the light diffuser 20 to be raised above the light-diffuser-retaining portion 18 of the base assembly and to permit a bottom portion of the light diffuser 20 to clear a top portion of the lamp 42, to permit the light diffuser 20 to be removed sideways from the lantern apparatus 10 for replacement of the lamp 42, and to permit the light diffuser 20 to be returned to the light-diffuser-retaining portion 18 of the base assembly 12. After the lamp 42 is changed, the light diffuser 20 is carried back to the light-diffuser-retaining portion 18 of the base assembly 12 and lowered onto the light-diffuser-retaining portion 18 causing the resilient leaves 36 to spread and receive the light diffuser 20.

The lamp assembly 30 is powered by DC current derived from combined voltage step down transformer and an AC to DC converter 38. Stepped down AC current flows through conductors 35 from the combined voltage step down transformer and AC to DC converter 38 and then to the lamp 42. A plug 37, attached to the conductors 35, is adapted to plug into a jack 39 installed in the base assembly 12.

Figure 5:
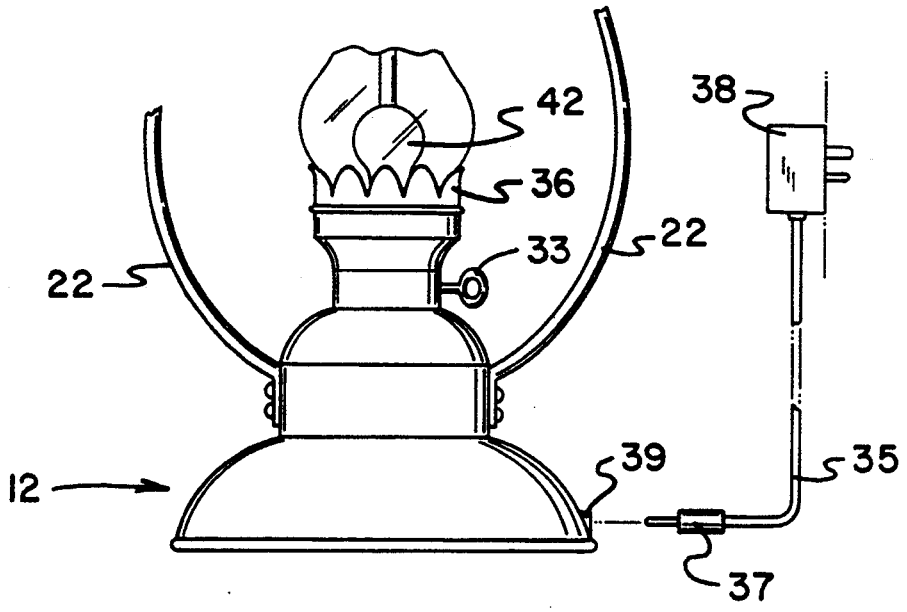
FIG. 5 is a partial side view of a second embodiment of the portable electric lantern apparatus of the invention which includes rechargeable batteries.
Figure 6:
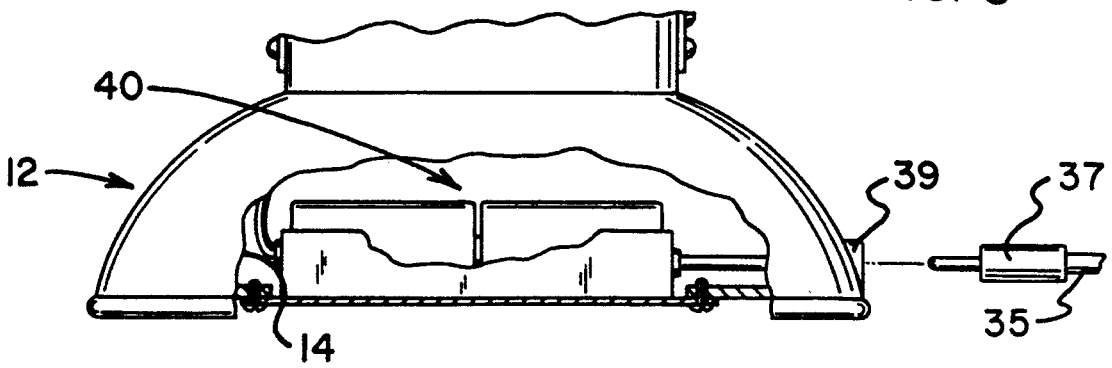
FIG. 6 is an enlarged partially broken away view of an array of rechargeable batteries used for powering the electric lamp.

Turning to FIGS. 5–6, a second embodiment of the invention is shown. Reference numerals are shown that correspond to like reference numerals that designate like elements shown in the other figures. In addition, a lamp assembly 30 is powered by DC current derived from a battery supply 40. The battery supply 40 is stored in the housing portion 14 of the base assembly 12. The battery supply 40 includes rechargeable batteries.

Figure 7:
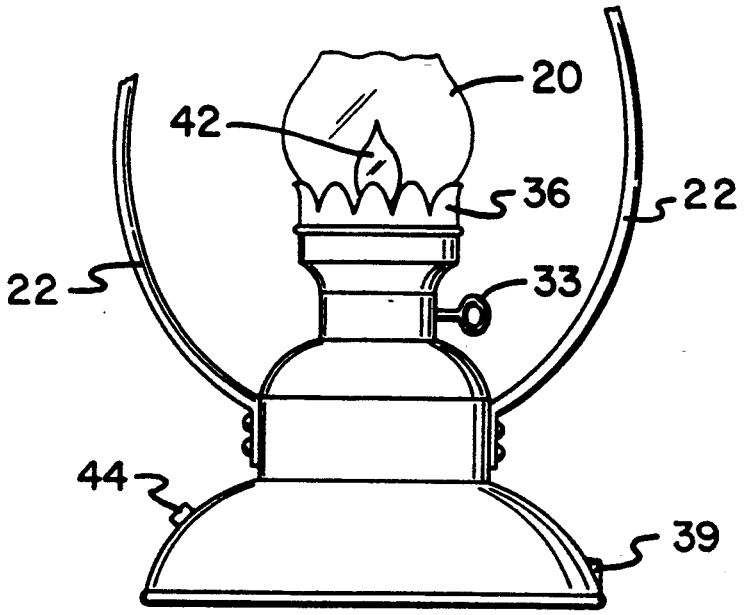
FIG. 7 is a partial side view of a third embodiment of the portable electric lantern apparatus of the invention which includes a light bulb shaped like a flame.
Figure 8:
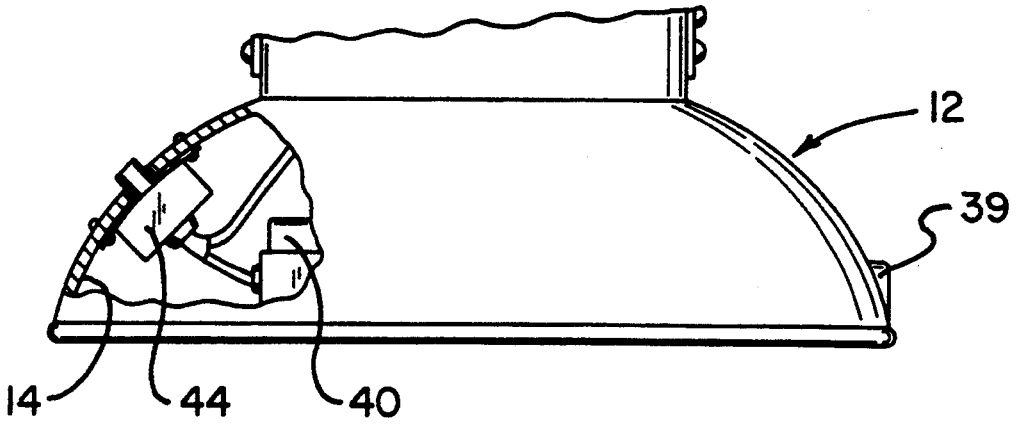
FIG. 8 is an enlarged, partially broken away view of the embodiment of the invention shown in FIG. 7 which includes an electrical module which causes the lamp to provide a flickering light.

Turning to FIGS. 7–8, a third embodiment of the invention is shown. Reference numerals are shown that correspond to like reference numerals that designate like elements shown in the other figures. In addition, the lamp assembly 30 includes a lamp 42 that includes a bulbous bottom portion and pointed top portion such that the lamp 42 resembles a flame. An illumination modulation assembly 44 is placed in an electrical circuit between the lamp 42 and the electrical power source. The illumination modulation assembly 44 includes a circuit interrupter for causing illumination from the lamp 42 to flicker in simulation of a flame. The illumination modulation assembly 44 includes a dimmer assembly for dimming illumination provided by the lamp 42. The illumination modulation assembly 44 includes both a circuit interrupter for causing illumination from the lamp 42 to flicker in simulation of a flame, and includes a dimmer assembly for dimming illumination provided by the lamp 42. Alternatively, the lamp 42 itself may have flicker characteristics of its own. With this type of lamp 42, the circuit interrupter would not be necessary.

The components of the portable electric lantern apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved portable electric lantern apparatus that is low in cost, relatively simple in design and operation, and which may advantageously be used to provide desirable features of a fuel-oil powered lantern without having the disadvantages associated with the oil lantern. With the invention, a portable electric lantern apparatus is provided which has a relatively long, vertically oriented, light diffuser which provides a utilitarian as well as an aesthetic function. With the invention, a portable electric lantern apparatus is provided which has quite a bit of its weight relatively close to its base providing it with a low center of gravity which provides substantial stability against being tipped over. With the invention, a portable electric lantern apparatus is provided which has a wire handle that is located above the lamp.

With the invention, a portable electric lantern apparatus is provided which precludes the presence of a liquid fuel that is unpleasantly odorous and that gives off vapors that may be unhealthy to breath. With the invention, a portable electric lantern apparatus is provided which precludes fuel leaks and eliminates a fire hazard that can result from a fuel leak. With the invention, a portable electric lantern apparatus is provided which does not present a problem of incomplete fuel combustion, does not require replenishment of a liquid fuel, does not require a match to start, and does not require two free hands to start the lantern to illuminate. With the invention, a portable electric lantern apparatus is provided which provides illumination in a 360 degree circle.

With the invention, a portable electric lantern apparatus is provided which includes a centrally disposed source of illumination. With the invention, a portable electric lantern apparatus is provided which does not include a structural support rod that also serves as an electrical conductor in the lamp circuit. With the invention, a portable electric lantern apparatus is provided which includes a light diffuser which is not required to provide structural support for a battery and a battery case. With the invention, a portable electric lantern apparatus is provided which has a flickering light source.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved portable electric lantern apparatus, comprising:

a base assembly which includes a housing portion, a lamp-supporting portion supported by said housing portion, and a light-diffuser-retaining portion supported by said lamp-supporting portion, a plurality of strut members connected to said base assembly and projecting upward from said base assembly, a handle-supporting assembly connected to said strut members, a handle supported by said handle-supporting assembly, said handle located above said base assembly and above said strut members, said handle connected to said handle-supporting assembly by a pivoted connection, a light diffuser supported by said light-diffuser-retaining portion of said base assembly, said light diffuser extending upward from said base assembly toward said handle-supporting assembly, a lamp assembly supported by said lamp-supporting portion of said base assembly, said lamp assembly being supported by said lamp-supporting portion such that said lamp assembly is centrally disposed in said light diffuser when said light diffuser is supported by said light-diffuser-retaining portion of said base assembly, wherein a combination of top portions of said strut members and said handle-supporting assembly are positioned a sufficient distance from said base assembly and said light diffuser such that a clearance is provided between said light diffuser and said handle-supporting assembly which is sufficient to permit said light diffuser to be raised above said light-diffuser-retaining portion of said base assembly and to clear a top portion of said lamp assembly, to permit said light diffuser to be removed sideways from the lantern apparatus through a space between the strut members for replacement of said lamp assembly, and to permit said light diffuser to be returned to said light-diffuser-retaining portion of said base assembly, a switch assembly supported by said base assembly for controlling operation of said lamp assembly, and an electrical power source which includes an electrical conductor assembly supported by said base assembly and connected to said lamp assembly and said switch assembly for providing electrical power to said lamp assembly and said switch assembly.

2. The apparatus described in claim 1 wherein said switch assembly is supported by said lamp-supporting portion of said base assembly.

3. The apparatus described in claim 1 wherein said handle includes a curved portion adapted to be hung from a wall fastener.

4. The apparatus described in claim 1 wherein said light-diffuser-retaining portion is comprised of a plurality of resilient leaves arrayed circumferentially around said light diffuser.

5. The apparatus described in claim 1 wherein said lamp assembly is powered by DC current derived from a voltage step down transformer and an AC to DC converter.

6. The apparatus described in claim 1 wherein said lamp assembly is powered by DC current derived from a battery supply.

7. The apparatus described in claim 6 wherein said battery supply is stored in said housing portion of said base assembly.

8. The apparatus described in claim 7 wherein said battery supply includes rechargeable batteries.

9. The apparatus described in claim 1 wherein said lamp assembly includes a lamp that includes a bulbous bottom portion and pointed top portion such that said lamp resembles a flame.

10. The apparatus described in claim 1, further including:

an illumination modulation assembly placed in an electrical circuit between said lamp assembly and said electrical power source and connected therebetween.

11. The apparatus described in claim 10 wherein said illumination modulation assembly includes a circuit interrupter for causing illumination from a lamp in said lamp assembly to flicker in simulation of a flame.

12. The apparatus described in claim 10 wherein said illumination modulation assembly includes a dimmer assembly for dimming illumination provided by said lamp assembly.

13. A new and improved portable electric lantern apparatus, comprising:

a base assembly which includes a housing portion, a lamp-supporting portion supported by said housing portion, and a light-diffuser-retaining portion supported by said lamp-supporting portion, a plurality of strut members connected to said base assembly and projecting upward from said base assembly, a handle-supporting assembly connected to said strut members, a handle supported by said handle-supporting assembly, said handle located above said base assembly and above said strut members, said handle connected to said handle-supporting assembly by a pivoted connection, a light diffuser supported by said light-diffuser-retaining portion of said base assembly, said light diffuser extending upward from said base assembly toward said handle-supporting assembly, a lamp assembly supported by said lamp-supporting portion of said base assembly, said lamp assembly being supported by said lamp-supporting portion such that said lamp assembly is centrally disposed in said light diffuser when said light diffuser is supported by said light-diffuser-retaining portion of said base assembly, wherein a combination of top portions of said strut members and said handle-supporting assembly are positioned a sufficient distance from said base assembly and said light diffuser such that a clearance is provided between said light diffuser and said handle-supporting assembly which is sufficient to permit said light diffuser to be raised above said light-diffuser-retaining portion of said base assembly and to clear a top portion of said lamp assembly, to permit said light diffuser to be removed sideways from the lantern apparatus through a space between the strut members for replacement of said lamp assembly, and to permit said light diffuser to be returned to said light-diffuser-retaining portion of said base assembly, a switch assembly supported by said base assembly for controlling operation of said lamp assembly, and an electrical power source supported by said base assembly and connected to said lamp assembly and switch assembly for providing electrical power to said lamp assembly and said switch assembly, an illumination modulation assembly placed in an electrical circuit between said lamp assembly and said electrical power source and connected therebetween, wherein said illumination modulation assembly includes both a circuit interrupter for causing illumination from said lamp assembly to flicker in simulation of a flame, and includes a dimmer assembly for dimming illumination provided by said lamp assembly.

* * * * *